US007797088B2

(12) United States Patent
Philp et al.

(10) Patent No.: US 7,797,088 B2
(45) Date of Patent: Sep. 14, 2010

(54) METHOD AND APPARATUS FOR PLANNING LINKED TRAIN MOVEMENTS

(75) Inventors: Joseph Wesley Philp, Indialantic, FL (US); Mitchell Scott Wills, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 1002 days.

(21) Appl. No.: 11/415,274

(22) Filed: May 2, 2006

(65) Prior Publication Data

US 2007/0260368 A1 Nov. 8, 2007

(51) Int. Cl.
*G08G 1/00* (2006.01)

(52) U.S. Cl. ..... 701/19; 104/137

(58) Field of Classification Search ..... 701/19, 701/20, 117; 104/137, 307; 246/2 R, 14, 246/27, 34 CT, 98
See application file for complete search history.

(56) References Cited

U.S. PATENT DOCUMENTS

| | | | |
|---|---|---|---|
| 3,575,594 | A | 4/1971 | Elcan |
| 3,734,433 | A | 5/1973 | Metzner |
| 3,794,834 | A | 2/1974 | Auer, Jr. et al. |
| 3,839,964 | A | 10/1974 | Gayot |
| 3,895,584 | A | 7/1975 | Paddison |
| 3,944,986 | A | 3/1976 | Staples |
| 4,099,707 | A | 7/1978 | Anderson |
| 4,122,523 | A | 10/1978 | Morse et al. |
| 4,361,300 | A | 11/1982 | Rush |
| 4,361,301 | A | 11/1982 | Rush |
| 4,610,206 | A | 9/1986 | Kubala et al. |
| 4,669,047 | A | 5/1987 | Chucta |
| 4,791,871 | A | 12/1988 | Mowll |
| 4,843,575 | A | 6/1989 | Crane |
| 4,883,245 | A | 11/1989 | Erickson, Jr. |
| 4,926,343 | A | 5/1990 | Tsuruta et al. |
| 4,937,743 | A | 6/1990 | Rassman et al. |
| 5,038,290 | A | 8/1991 | Minami |
| 5,063,506 | A | 11/1991 | Brockwell et al. |
| 5,177,684 | A | 1/1993 | Harker et al. |
| 5,222,192 | A | 6/1993 | Shafer |
| 5,229,948 | A | 7/1993 | Wei et al. |
| 5,237,497 | A | 8/1993 | Sitarski |
| 5,265,006 | A | 11/1993 | Asthana et al. |
| 5,289,563 | A | 2/1994 | Nomoto et al. |
| 5,311,438 | A | 5/1994 | Sellers et al. |
| 5,331,545 | A | 7/1994 | Yajima et al. |
| 5,332,180 | A | 7/1994 | Peterson et al. |

(Continued)

FOREIGN PATENT DOCUMENTS

| | | |
|---|---|---|
| CA | 2057039 | 12/1990 |

(Continued)

OTHER PUBLICATIONS

Crone, et al., "Distributed Intelligent Network Management for the SDI Ground Network," IEEE, 1991, pp. 722-726, MILCOM '91.

(Continued)

*Primary Examiner*—Dalena Tran
(74) *Attorney, Agent, or Firm*—Duane Morris LLP

(57) ABSTRACT

A scheduling system and method for identifying and planning for the linked movement of two or more trains.

11 Claims, 1 Drawing Sheet

U.S. PATENT DOCUMENTS

| | | | | |
|---|---|---|---|---|
| 5,335,180 | A | 8/1994 | Takahashi et al. | |
| 5,365,516 | A | 11/1994 | Jandrell | |
| 5,390,880 | A | 2/1995 | Fukawa et al. | |
| 5,420,883 | A | 5/1995 | Swensen et al. | |
| 5,437,422 | A | 8/1995 | Newman | |
| 5,463,552 | A | 10/1995 | Wilson et al. | |
| 5,467,268 | A | 11/1995 | Sisley et al. | |
| 5,487,516 | A | 1/1996 | Murata et al. | |
| 5,541,848 | A | 7/1996 | McCormack et al. | |
| 5,623,413 | A | 4/1997 | Matheson et al. | |
| 5,745,735 | A | 4/1998 | Cohn et al. | |
| 5,794,172 | A | 8/1998 | Matheson et al. | |
| 5,823,481 | A | 10/1998 | Gottschlich | |
| 5,825,660 | A | 10/1998 | Cagan et al. | |
| 5,828,979 | A | 10/1998 | Polivka et al. | |
| 5,850,617 | A | 12/1998 | Libby | |
| 6,032,905 | A | 3/2000 | Haynie | |
| 6,115,700 | A | 9/2000 | Ferkinhoff et al. | |
| 6,125,311 | A | 9/2000 | Lo | |
| 6,144,901 | A | 11/2000 | Nickles et al. | |
| 6,154,735 | A | 11/2000 | Crone | |
| 6,250,590 | B1 | 6/2001 | Hofestadt et al. | |
| 6,351,697 | B1 | 2/2002 | Baker | |
| 6,377,877 | B1 | 4/2002 | Doner | |
| 6,393,362 | B1 | 5/2002 | Burns | |
| 6,405,186 | B1 | 6/2002 | Fabre et al. | |
| 6,459,965 | B1 | 10/2002 | Polivka et al. | |
| 6,587,764 | B2 | 7/2003 | Nickles et al. | |
| 6,637,703 | B2 | 10/2003 | Matheson et al. | |
| 6,654,682 | B2 | 11/2003 | Kane et al. | |
| 6,766,228 | B2 | 7/2004 | Chirescu | |
| 6,789,005 | B2 | 9/2004 | Hawthorne | |
| 6,799,097 | B2 | 9/2004 | Villarreal Antelo et al. | |
| 6,799,100 | B2 | 9/2004 | Burns | |
| 6,853,889 | B2 | 2/2005 | Cole | |
| 6,856,865 | B2 | 2/2005 | Hawthorne | |
| 7,006,796 | B1 | 2/2006 | Hofmann et al. | |
| 7,340,328 | B2 * | 3/2008 | Matheson et al. | 701/19 |
| 7,457,691 | B2 * | 11/2008 | Muinonen et al. | 701/19 |
| 2003/0105561 | A1 | 6/2003 | Nickles et al. | |
| 2003/0183729 | A1 | 10/2003 | Root et al. | |
| 2004/0010432 | A1 | 1/2004 | Matheson et al. | |
| 2004/0034556 | A1 | 2/2004 | Matheson et al. | |
| 2004/0093196 | A1 | 5/2004 | Hawthorne | |
| 2004/0093245 | A1 | 5/2004 | Matheson et al. | |
| 2004/0267415 | A1 | 12/2004 | Lacote et al. | |
| 2005/0107890 | A1 | 5/2005 | Minkowitz et al. | |
| 2005/0192720 | A1 | 9/2005 | Christie et al. | |
| 2006/0074544 | A1 | 4/2006 | Morariu et al. | |

FOREIGN PATENT DOCUMENTS

| | | |
|---|---|---|
| CA | 2066739 | 2/1992 |
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| GB | 1321053 | 6/1973 |
| GB | 1321054 | 6/1973 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanbe, et al., "Moving Block System with Continuous Train Detection Utilizing Train Shunting Impedance of Track Circuit," QR of RTRI, vol. 30, No. 4, Nov. 1989, pp. 190-197.

* cited by examiner

METHOD AND APPARATUS FOR PLANNING LINKED TRAIN MOVEMENTS

RELATED APPLICATIONS

The present application is being filed concurrently with the following related applications, each of which is commonly owned:

application Ser. No. 11/415,273 entitled "Method of Planning Train Movement Using a Front End Cost Function";

application Ser. No. 11/415,275 entitled "Method and Apparatus for Planning the Movement of Trains Using Dynamic Analysis"; and application Ser. No. 11/415,272 entitled "Method of Planning the Movement of Trains Using Route Protection."

The disclosure of each of the above referenced applications including those concurrently filed herewith is hereby incorporated herein by reference.

BACKGROUND OF THE INVENTION

The present invention relates to the scheduling of movement of plural units through a complex movement defining system, and in the embodiment disclosed, to the scheduling of the movement of freight trains over a railroad system and specifically to the scheduling of linked resources.

Systems and methods for scheduling the movement of trains over a rail network have been described in U.S. Pat. Nos. 6,154,735, 5,794,172, and 5,623,413, the disclosure of which is hereby incorporated by reference.

As disclosed in the referenced patents and applications, the complete disclosure of which is hereby incorporated herein by reference, railroads consist of three primary components (1) a rail infrastructure, including track, switches, a communications system and a control system; (2) rolling stock, including locomotives and cars; and, (3) personnel (or crew) that operate and maintain the railway. Generally, each of these components are employed by the use of a high level schedule which assigns people, locomotives, and cars to the various sections of track and allows them to move over that track in a manner that avoids collisions and permits the railway system to deliver goods to various destinations.

As disclosed in the referenced patents and applications, a precision control system includes the use of an optimizing scheduler that will schedule all aspects of the rail system, taking into account the laws of physics, the policies of the railroad, the work rules of the personnel, the actual contractual terms of the contracts to the various customers and any boundary conditions or constraints which govern the possible solution or schedule such as passenger traffic, hours of operation of some of the facilities, track maintenance, work rules, etc. The combination of boundary conditions together with a figure of merit for each activity will result in a schedule which maximizes some figure of merit such as overall system cost.

As disclosed in the referenced patents and applications, and upon determining a schedule, a movement plan may be created using the very fine grain structure necessary to actually control the movement of the train. Such fine grain structure may include assignment of personnel by name, as well as the assignment of specific locomotives by number, and may include the determination of the precise time or distance over time for the movement of the trains across the rail network and all the details of train handling, power levels, curves, grades, track topography, wind and weather conditions. This movement plan may be used to guide the manual dispatching of trains and controlling of track forces, or may be provided to the locomotives so that it can be implemented by the engineer or automatically by switchable actuation on the locomotive.

The planning system is hierarchical in nature in which the problem is abstracted to a relatively high level for the initial optimization process, and then the resulting course solution is mapped to a less abstract lower level for further optimization. Statistical processing is used at all levels to minimize the total computational load, making the overall process computationally feasible to implement. An expert system is used as a manager over these processes, and the expert system is also the tool by which various boundary conditions and constraints for the solution set are established. The use of an expert system in this capacity permits the user to supply the rules to be placed in the solution process.

Currently, online real-time movement planners do not have the capability to identify and accommodate linked train movements. Linked trains are trains in which the movement of one or more trains is dependent on the movement of at least one other train. Typical scenarios of linked movements include (a) meet/pass—the first train to arrive at the meet or pass location must wait for passage of the train being met before it proceeds, (b) block swap—a train scheduled to pick up a block of cars cannot do so until another train has arrived and set them out, (c) middle annul (train combination)—A portion of a train's route may be annulled and its consist assigned to another train which requires that the combined train (the train into which the consist is consolidated) cannot depart until the annulled train has arrived with the car blocks and the annulled train cannot resume its route past the annulled portion until the combined train has arrived and set out the car blocks, and (d) helper train—if a train has insufficient power for grade, a helper locomotive is assigned to assist which requires that the assisted train cannot depart the helper cut-in location until arrival of the helper train, and the helper train cannot depart the helper cut-out location until arrival of the assisted train.

Typically, linked train movements required manual intervention by a dispatcher or could be accommodated grossly by offline static planners by setting desired arrival and departure times in the case of block swaps. The linked train scenarios are difficult to accommodate in the train movement plan not only because the departure of one train is dependent upon the arrival of another train, but also because a dwell time may be required to perform the pickup or setout.

Another linked scenario which could not be accommodated by prior art movement planners is when all or part of a consist is moved between linked trains resulting in a change in the trains' characteristics. For example, when a consist having a high priority is picked up by a train having a lower priority, there has been no mechanism for automatically changed the priority of the train to reflect the addition of the higher priority consist.

The current disclosure provides a system and method of incorporating train movement linkage in the planning algorithm so that the planned movement of a linked train takes into account the movement of the train to which it is linked. Additionally, the present system and method can dynamically adjust train characteristics at linkage points.

These and many other objects and advantages of the present invention will be readily apparent to one skilled in the art to which the invention pertains from a perusal of the claims, the appended drawings, and the following detailed description of the embodiments.

DETAILED DESCRIPTION

Figure 1:
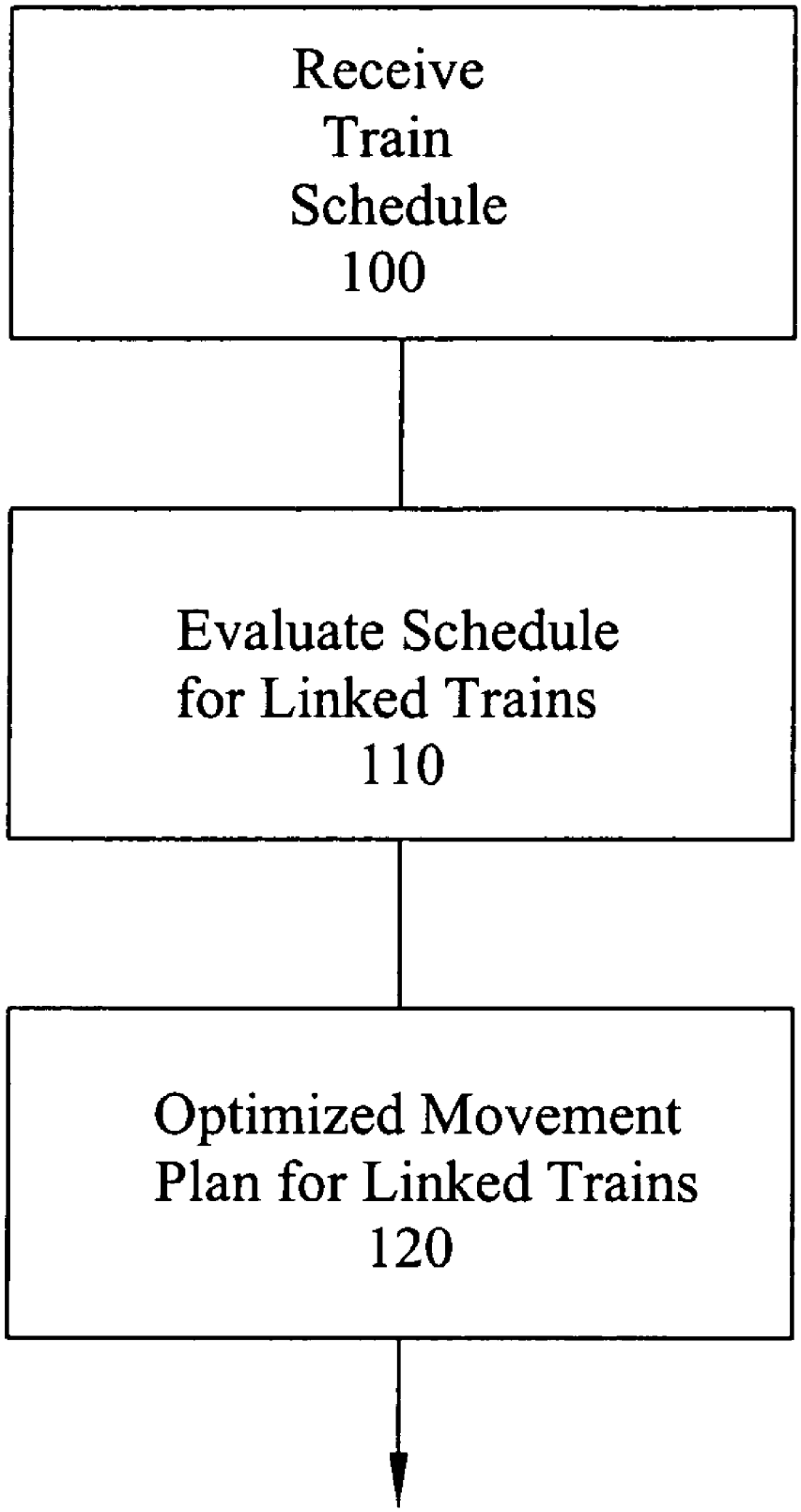
FIG. 1 is a simplified pictorial representation of one embodiment of planning the movement of linked trains.

A train can be said to be linked to another train when the planned movement of one train is dependent on the planned movement of at least one other train. For example, if a rail car is scheduled to be set out by one train and picked up by another train, the train that is picking up can not do so until after the rail car has been set out by the other train. In one embodiment of the present invention, these two linked trains would be identified by the movement planner as being linked and thus their movement would be optimized taking this dependency into account, rather than being optimized independently as was done in the prior art.

FIG. 1 is a simplified pictorial representation of one method of planning the movement of linked trains. A rail road may provide a schedule 100 of the desired movement of its trains through the rail network, including times of arrival and departure of the trains at various points in the rail network. The train schedule may also include an identification of the cars in the consist as well as a code associating cars having common destinations along the scheduled route, i.e., a block code. The train schedule may be evaluated 110 to determine linked movements between the trains. The identification of two linked trains can be done be evaluating the block code or other identifier which associates rail cars. In another embodiment the identification of liked trains can be done by evaluating the train schedule for linked activities.

Once the linked trains are identified, movement plans for the linked trains can be optimized 120. The optimized plans take into account the dependency between the trains. Additionally, once the linking between trains is established, any subsequent modification to the movement plan for one of the trains will cause the movement plan for the linked train to be evaluated to see if further optimization is necessary. The movement plans for the linked trains can be optimized using any of several well known techniques, including those described in the referenced applications and patents.

In one embodiment of the present invention, any deviations in the movement plan of one train may trigger a re-planning of all trains linked to the affected train. For example, a train may require a helper for a specific portion of the rail network. If the train becomes delayed, the planning system, in addition to modifying the movement plan of the train, may also modify the movement plan of the helper and may make the helper available to other trains.

In another embodiment, the identification of the linked trains, as well as the linked activity and location of the linked activity are determined. This information can be used by the planning system to automatically update the characteristics of a train as a result of the linked activity. For example, a low value train that picks up a high value car automatically is assigned the high value of the addition to the consist. Thus any modification of the movement plan for the train takes into account the new high value of the train. Train characteristic information can include physical characteristics of the train such as weight, length, width, height, as well as no physical characteristics such as type of cargo, importance of cargo, penalty provisions, etc. Thus the identification and location of the linked activity is valuable information to provide an optimized movement plan for the linked trains and represents information that was not previously available to automated planning systems. Thus, the present method enables a dynamic adjustment of a train value as influenced by train linkage.

The steps of identifying linked trains and optimized the movement of the linked trains can be implemented using computer usable medium having a computer readable code executed by special purpose or general purpose computers.

While embodiments of the present invention have been described, it is understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of controlling a movement of plural trains over a rail network comprising the steps of:

(a) providing a schedule for a planned movement of plural trains;

(b) identifying two or more trains having block swap activity;

(c) identifying a location of the block swap activity;

(d) monitoring the movement of the two or more trains;

(e) modifying characteristics of the two or more trains when the trains reach the block swap activity location; and (f) planning a movement of the two or more trains using the modified characteristics.

2. The method of claim 1 where the step of identifying includes identifying trains with the same block code.

3. The method of claim 1 wherein the train characteristic is one of weight, length, or importance.

4. The method of claim 1 wherein the block swap includes transferring at least one railcar between two trains.

5. The method of claim 4 wherein the transferred railcar has a higher priority than the other cars on the train it is being transferred to.

6. The method of claim 1 wherein the characteristic is a function of the cargo.

7. A method of controlling a movement of plural trains over a rail network comprising the steps of:

(a) providing a schedule for a planned movement of plural trains;

(b) identifying two or more trains having middle annul activity;

(c) identifying a location of the middle annul activity;

(d) monitoring the movement of the two or more trains;

(e) modifying characteristics of the two or more trains when the trains reach the middle annul activity location; and (f) planning the movement of the two or more trains using the modified characteristics.

8. The method of claim 7 wherein the train characteristic is one of weight, length, or importance.

9. A computer readable storage medium storing a computer program for controlling the movement of plural trains over a rail network, the computer program comprising:

a computer usable medium having computer readable program code modules embodied in said medium for planning a movement of trains;

a computer readable first program code module for providing a schedule for the planned movement of plural trains, a computer readable second program code module for identifying two or more trains having block swap activity, a computer readable third program code module for identifying a location of the block swap activity;

a computer readable fourth program code module for monitoring the movement of the two or more trains;

a computer readable fifth program code module for modifying characteristics of the two or more trains when the trains reach the block swap activity location; and a computer readable sixth program code module for planning the movement of the two or more trains using the modified characteristics.

10. The computer program of claim 9 wherein the block swap includes transferring at least one railcar between two trains.

11. The computer program of claim 9 wherein the characteristics include one of physical and non-physical characteristics.

* * * * *